US006431836B2

(12) United States Patent
Zimmermann

(10) Patent No.: US 6,431,836 B2
(45) Date of Patent: Aug. 13, 2002

(54) BLADE LOCK AND PROCESS FOR MANUFACTURING A BLADE LOCK

(75) Inventor: Achim Zimmermann, Mülheim (DE)

(73) Assignee: MAN Turbomaschinen AG GHH BORSIG (DE)

( * ) Notice: Subject to any disclaimer, the term of this patent is extended or adjusted under 35 U.S.C. 154(b) by 0 days.

(21) Appl. No.: 09/790,083

(22) Filed: Feb. 21, 2001

(30) Foreign Application Priority Data

Mar. 14, 2000 (DE) ..... 100 12 381

(51) Int. Cl.[7] ..... F01D 5/32

(52) U.S. Cl. ..... 416/220 R; 416/193 A; 416/500; 416/215; 29/889.21

(58) Field of Search ..... 416/220 R, 219 R, 416/193 A, 215, 216, 217, 218, 221, 500; 29/889.21, 889.2, 889.1

(56) References Cited

U.S. PATENT DOCUMENTS 2,942,842 A * 6/1960 Hayes ..... 416/220 R
3,198,485 A * 8/1965 Melenchuk ..... 416/220 R
4,050,850 A * 9/1977 Beckershoff ..... 416/193 A
4,255,086 A * 3/1981 Roberts ..... 29/889.21
4,684,325 A * 8/1987 Arnold ..... 29/889.21
5,074,754 A * 12/1991 Violette ..... 416/248

FOREIGN PATENT DOCUMENTS

DE 30 28 701 2/1982
GB 640532 7/1950
JP 59-192801 A * 11/1984 ..... 416/220 R

* cited by examiner

*Primary Examiner*—Edward K. Look
*Assistant Examiner*—Richard Woo
(74) *Attorney, Agent, or Firm*—McGlew and Tuttle, P.C.

(57) ABSTRACT

The blades (3) of a turbine of axial design are inserted into an undercut blade groove (2) of the turbine rotor (1) in a positive-locking manner and are secured by a blade lock. The blade lock comprises a mounting space (7), which is in connection with the blade groove (2) and into which a filler piece (8), which is in positive-locking relationship with the blade foot (6) of the blades (3), and a wedge (9) are inserted. The cross section of the mounting space (7) receiving the filler piece (8) is widened conically beginning from the blade groove (2). The cross section of the filler piece (8) is adapted to the cross section of the mounting space (7).

11 Claims, 1 Drawing Sheet

BLADE LOCK AND PROCESS FOR MANUFACTURING A BLADE LOCK

FIELD OF THE INVENTION

The present invention pertains to a blade lock for blading a turbine of an axial design, with blades inserted into an undercut blade groove of the turbine rotor in a positive-locking manner, the blade groove being in connection with at least one mounting space and where a filler piece, which is in positive-locking relationship with a blade foot of the blades and a wedge are inserted into the mounting space. The present invention also pertains to a process for manufacturing a blade lock.

BACKGROUND OF THE INVENTION

A blade lock for blading turbines, in which the rotor blades are inserted into an undercut blade groove of the turbine rotor extending in the circumferential direction in a positive-locking manner, has become known from DE-OS 30 28 701. At least one mounting space, into which a filler piece which is in positive-locking relationship with the foot of the blade is inserted, is provided on the circumference of the turbine rotor. The filler piece is pressed in tightly by a fitting piece, which is driven in between the wall of the mounting space and the filler piece. To increase the pressing force, the fitting piece is slotted, and a wedge is pressed into the slot during the driving in of the fitting piece into the mounting space.

In the prior-art blade lock, the pressing force acts on the foot of the blade and consequently on the turbine rotor via the fitting piece or the wedge. This may lead to warping and bending of the turbine rotor if the wedge has been driven in too tightly. The hot true running behavior of the turbine rotor may be adversely affected during the operation of the turbine, which may lead to an increase in the vibrations of the shaft.

SUMMARY AND OBJECTS OF THE INVENTION

The basic object of the present invention is to design the blade lock of this type such that no pressing force is exerted on the turbine rotor.

According to the invention, a blade lock for blading a turbine of an axial design is provided wherein the blades are inserted into an undercut blade groove of the turbine rotor in a positive-locking manner. The blade groove is in connection with at least one mounting space or mounting point and a filler piece which is in positive-locking relationship with the blade foot of the blades and a wedge are inserted into the mounting space. The cross section of the mounting space receiving the filler piece is conically widened beginning from the blade groove. The cross section of the filler piece is adapted to the cross section of the mounting space.

The side walls of the mounting space may be provided to extend at an angle to the blade groove. The side walls of the mounting space may be provided to form an angle ($\alpha_1$, $\alpha_2$) with the longitudinal axis of the blade in the axial direction. The wedge may be secured by stud screws in the turbine rotor.

According to another aspect of the invention, a process for manufacturing a blade lock as discussed above is provided. According to this process, after preparing the blade groove by turning, the filler piece, which has been prepared except for the blade groove contour, is inserted into the prepared mounting space and is fixed by a wedge. The blade groove contour is milled in the blade groove and at the same time in the filler piece. The filler piece and the wedge are removed from the mounting space. The turbine rotor is then equipped with the blades and the blades are secured in the blade groove by the blade lock.

The filler piece is held in the axial direction in the mounting space designed according to the present invention such that it is not pressed against the foot of the blade but is supported during the wedging in the mounting space in the turbine rotor. As a result, the warping force between the filler piece and the wedge no longer acts on the foot of the blade, and the axial pressing force is no longer passed through the blade groove. The turbine rotor is not subject to axial warping. The introduction of the blade lock cannot lead to bending of the turbine rotor during the manufacturing process. An adverse effect of a blade lock inserted too tightly on the hot true running behavior of the turbine rotor is ruled out. Each blade of a blade groove including the closing blade finds the same blade groove dimensions and clamping conditions.

The clamping of the wedged filler piece in the mounting space according to the present invention makes it possible to manufacture the blade lock according to the process, in which the contour of the groove of the filler piece and that of the blade groove are prepared in a common work mounting. This leads to a very high accuracy of fit of the filler piece and the wedge.

The present invention can be used generally for turbines of axial design operating as reaction or impulse turbines for steam turbines and process gas or tail gas turbines and especially for blade locks for blade feet of the hammerhead or double hammerhead design.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
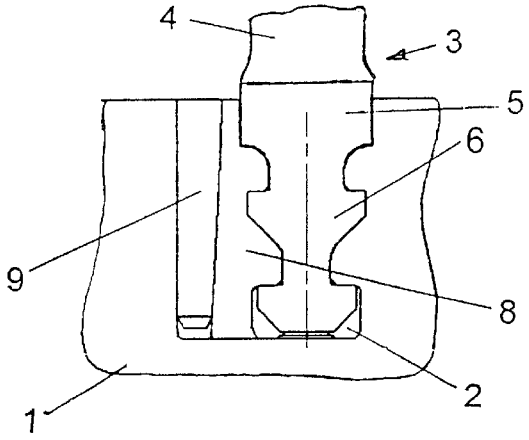
FIG. 1 is a sectional view of a detail of a turbine rotor.

Referring to the drawings in particular, a blade groove 2 with an undercut blade groove contour is cut in the circumferential direction into the turbine rotor 1 of a turbine of axial design. Rotor blades 3, which comprise a blade pan 4, which passes over into a blade foot 6 via a blade rhomboid 5, are circumferentially inserted into the blade groove 2. A rectangle may also be considered instead of a rhomboid. The blade feet 6 engage the blade groove 2 with a contour corresponding to the contour of the blade groove. This contour is designed as a double laid hammerhead in this exemplary embodiment.

A mounting space or mounting region 7, via which the blades 3 are introduced into the blade groove 2, is provided at least at one point along the blade groove 2. After the blades 3 have been inserted, a filler piece 8 is inserted into the mounting space 7. The filler piece 8 has a contour corresponding to that of the blade groove contour and engages with this contour the blade foot 6 of the blade lock. The filler piece 8 is wedged in the mounting space 7 by means of a wedge 9, which is driven into the mounting space 7 on the side of the filler piece 8 facing away from the blade 3.

Figure 2:
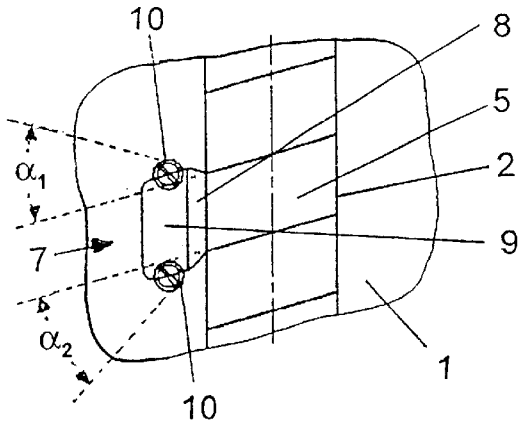
FIG. 2 is a top view of FIG. 1.
Figure 3:
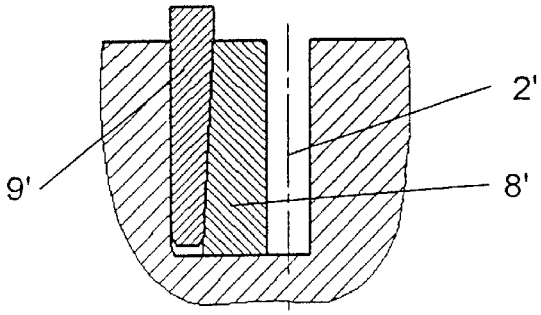
FIG. 3 is a sectional view through a prepared blade groove with blanks inserted.
Figure 4:
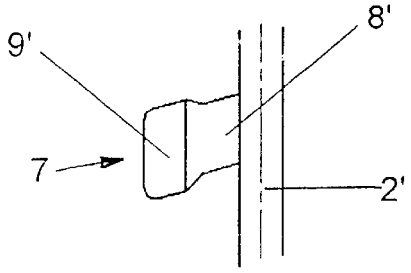
FIG. 4 is a top view of the prepared blade groove with blanks inserted of FIG. 3.

The cross section of the mounting space 7 receiving the filler piece 8 widens conically beginning from the blade groove 2. As is shown in FIG. 2, the side walls of the mounting space 7 form an angle $\alpha_1$, $\alpha_2$ with the longitudinal axis of the blade 3. This angle is determined by the angle of the blade rhomboid. The angles may be different from one case to the next, and they may also be different in the blade lock. The filler piece 8 correspondingly also has two conically tapering side surfaces adapted to the mounting space 7.

The wedge 9 which is in contact with the rear side of the filler piece 8 is driven into the mounting space 7 to the extent that a distance is left between the front edge of the wedge 9 and the bottom of the mounting space 7.

The wedge 9 is secured by two stud screws 10 in the installed state. These stud screws are screwed into holes which were prepared in the turbine rotor 1 at the contact surface between the wedge 9 and the wall of the mounting space 7.

The parts forming the blade lock are manufactured as follows. A rough-turned groove 2' forming the later blade groove 2 is turned in the turbine rotor 1 and the mounting space 7 is prepared by milling. A blank 8' for the filler piece 8 and a wedge blank 9' are inserted into the mounting space 7 and braced in the mounting space 7 by driving in the wedge blank 9'. The blank 8' for the filler piece 8 is prepared except for the blade groove contour. The wedge blank 9' needs to have an overlength or a threaded hole, so that it can again be pulled out after the finishing of the blade lock. After inserting the blank 8' for the filler piece 8 and the wedge blank 9', the final blade groove contour is prepared in the turbine rotor 1 by turning. At the same time, the blade groove contour is also prepared in the filler piece 8 by turning. After turning the blade groove contour, the blade lock is opened by pulling out the wedge blank 9' and removing the finished filler piece 8, after which the turbine rotor 1 is prepared for the blading. Before pulling out the wedge blank 9', its finished length is marked. The wedge 9 is brought to its finished dimension before the final insertion of the wedge 9 after the blading.

While specific embodiments of the invention have been shown and described in detail to illustrate the application of the principles of the invention, it will be understood that the invention may be embodied otherwise without departing from such principles.

What is claimed is:

1. A blade lock for blading an axial design turbine having a rotor and blades, wherein the blades are inserted into an undercut blade groove of said turbine rotor in a positive-locking manner, the blade lock comprising:

a mounting space in connection with the blade groove, said mounting space having a cross section, said mounting space having a longitudinal axis, said mounting space being asymmetric about said longitudinal axis when viewed in a radial direction;

a filler piece in positive-locking relationship with a blade foot of at least one of the blades, said filler piece being inserted into said mounting space and having a cross section adapted to said cross section of said mounting space, said cross section of said mounting space is conically widened beginning from the blade groove in an axial direction, said mounting space includes side walls, said side walls extending at an angle to the blade groove and form an angle with a longitudinal axis of the blade; and a wedge inserted into said mounting space.

2. A blade lock in accordance with claim 1, further comprising: stud screws in the turbine rotor wherein said wedge is secured by said stud screws in the turbine rotor.

3. A process for manufacturing a blade lock for blading an axial design turbine wherein blades are inserted into an undercut blade groove of a turbine rotor in a positive-locking manner, the blade lock including a mounting space in connection with the blade groove, said mounting space having a longitudinal axis, said mounting space being asymmetric about said longitudinal axis when viewed in a radial direction, a filler piece in positive-locking relationship with a blade foot of at least one of the blades and a wedge inserted into the mounting space, the mounting space having a cross section receiving the filler piece that is conically widened in an axial direction beginning from the blade groove, the filler piece having a cross section adapted to the cross section of the mounting space, the process comprising the steps of:

preparing the blade groove by turning;

subsequent to said step of preparing the blade groove by turning, inserting the filler piece, which has been prepared except for the blade groove contour, into the prepared mounting space;

fixing the filler piece with the wedge;

milling the blade groove contour in the blade groove and at the same time milling the blade groove contour in the filler piece;

removing the filler piece and the wedge from the mounting space; and equipping the turbine rotor with the blades and securing the blades in the blade groove by the blade lock.

4. A blade lock in accordance with claim 3, further comprising: stud screws in the turbine rotor wherein said wedge is secured by said stud screws in the turbine rotor.

5. A blade lock arrangement comprising:

a rotor defining a circumferential groove, said rotor also defining a mounting space axially extending from said circumferential groove, said mounting space having a longitudinal axis, said mounting space being asymmetric about said longitudinal axis when viewed :in a radial direction;

a filler piece insertable into said mounting space; and a wedge insertable into said mounting space.

6. A blade lock arrangement in accordance with claim 5, wherein side walls of said mounting space form an angle with a longitudinal axis of a blade in an axial direction.

7. A blade lock in accordance with claim 5, further comprising: stud screws in the turbine rotor wherein said wedge is secured by said stud screws in the turbine rotor.

8. A blade lock arrangement in accordance with claim 5, wherein:

said mounting space is arranged at an angle to said circumferential groove and angularly spaced from a perpendicular to said circumferential groove.

9. A blade lock arrangement in accordance with claim 5, wherein:

a blade root is arranged in said circumferential groove, said blade root has a side angularly spaced from a side of said circumferential groove; and said mounting space extends substantially parallel to said side of said blade root.

10. A blade lock arrangement in accordance with claim 9, wherein:

said side of said blade root is angularly spaced from a perpendicular to said circumferential groove; and said longitudinal axis of said mounting space extends substantially parallel to said side of said blade root.

11. A blade lock arrangement in accordance with claim 5, wherein:

said mounting space has side walls conically widening in an axial direction from said circumferential groove; and said filler piece has side walls substantially complementary to said side walls of said mounting space.

* * * * *